US006351920B1

(12) United States Patent
Hopkins et al.

(10) Patent No.: US 6,351,920 B1
(45) Date of Patent: Mar. 5, 2002

(54) CEILING MODULE PERIMETER SEAL

(75) Inventors: Larry Hopkins, Portland, OR (US); Craig S. Ludwig, White Salmon, WA (US)

(73) Assignee: Clean Pak International, Inc., Clackamas, OR (US)

( * ) Notice: Subject to any disclaimer, the term of this patent is extended or adjusted under 35 U.S.C. 154(b) by 0 days.

(21) Appl. No.: 09/299,234

(22) Filed: Apr. 22, 1999

(51) Int. Cl.[7] ..... E04B 2/00

(52) U.S. Cl. ..... 52/506.08; 52/488; 52/484; 52/486; 454/187; 55/355; 55/484

(58) Field of Search ..... 52/284, 287.1, 52/506.07, 506.08; 55/502, 484

(56) References Cited

U.S. PATENT DOCUMENTS 4,944,129 A * 7/1990 Hartleif ..... 52/486
4,967,530 A * 11/1990 Clunn ..... 52/484
4,986,050 A * 1/1991 Brunetti et al. ..... 52/488
5,279,632 A * 1/1994 Decker et al. ..... 55/355
5,314,516 A * 5/1994 Kashima ..... 55/484
5,540,028 A * 7/1996 Scott et al. ..... 52/506.8
5,620,369 A * 4/1997 Spransy et al. ..... 454/187
5,865,674 A * 2/1999 Starr ..... 454/187

* cited by examiner

*Primary Examiner*—Carl D. Friedman
*Assistant Examiner*—Steve M Varner
(74) *Attorney, Agent, or Firm*—Keith A. Cushing

(57) ABSTRACT

A ceiling module perimeter seal establishes an air-tight seal between modules forming a ceiling structure. The seal includes a groove about the perimeter of modules and aligned relative to a corresponding groove of an adjoining module. Aligned grooves in adjacent ceiling modules establish an enclosure between modules and apertures fluidly couple the enclosure with gel sealant troughs of the ceiling structure. Gel sealant flowing in the troughs enters the enclosure and thereby establishes an air tight seal between adjoining ceiling modules.

15 Claims, 5 Drawing Sheets

CEILING MODULE PERIMETER SEAL

FIELD OF THE INVENTION

The present invention relates generally to air movement and filtration, and more particularly to structures and methods establishing a seal against air bypassing filtration elements.

BACKGROUND OF THE INVENTION

Air filtration and movement systems as used in building structures provide a portion of an air recirculation system. Most modem building structures include some form of air movement, and often filtration, systems integrated into the building structure. In certain applications, for example hospitals and manufacturing cleanrooms, filtration plays a particularly important role in the air recirculation system. The present invention will be illustrated in the context of such applications requiring high levels of air quality or particular patterns of air flow within a controlled environment.

The ceiling structure supports filter panels and the controlled environment, typically the floor or side-walls, includes a number of air intake openings. Air forced through the filters moves into and through the controlled environment at a controlled rate and eventually enters the air intake openings. An air return system moves the air back above the ceiling and through the filters to establish a recirculation path for the air. In some applications, air flow is reversed moving upward through the controlled environment, through a set of filters at the ceiling, and thereafter returning to the controlled environment. In any case, particular levels of air purity and air flow control are required and depend on air flow passing only through the filters.

The following US patent documents, the disclosures of which are hereby fully incorporated by reference thereto, teach a variety of aspects of cleanroom ceiling structures including lighting, air movement, and fire suppression elements therein: U.S. Pat. No. 5,794,397 issued Aug. 18, 1998 and entitled Clean Room Ceiling Structure Light Fixture Wireway; U.S. Pat. No. 5,681,143 issued Oct. 28, 1997 and entitled Damper Control System for Centrifugal Fan; U.S. Pat. No. 5,613,759 issued Mar. 25, 1997 and entitled Light and Filter Support Structure; U.S. Pat. No. 5,207,614 issued May 4, 1993 and entitled Clean Room Air System; U.S. Pat. No. 5,192,348 issued Mar. 9, 1993 and entitled Directional Air Diffuser Panel for Clean Room Ventilation System; U.S. Pat. No. 5,014,608 issued May 14, 1991 and entitled Clean Room Air System; and U.S. Pat. No. 4,859,140 issued Aug. 22, 1989 and entitled Centrifugal Fan.

Cleanroom ceiling structures have been constructed in using rail elements to establish a plurality of rectangular spaces receiving the filter panels therein. Generally, a set of rail structures, e.g., extruded aluminum structures, organized in grid-fashion establish the support structure for the filter panels. In addition to filter support, cleanroom ceiling grid structures also incorporate lighting elements in downward-facing channels of the grid structure rail elements. Also, fire suppression systems have been incorporated into the grid structure and allow penetration, through the plane of the grid structure, by a fire sprinkler element coupled to water supply conduits thereabove. Ceiling grid structures have been built in modular form, sometimes constructed at an installation site and sometimes shipped from a manufacturing site to an installation site as a module. Modules join in an array to establish a ceiling grid structure.

Within grid modules, the rail elements include various structures and features including a downward-facing channel typically enclosing a light fixture and including one or more upward-facing troughs containing a gel sealant. The upward-facing troughs surround in moat-fashion each rectangular opening. Filter panels are placed over the rectangular openings. The filter panels include downward-projecting knife structures. The gel sealant enters the troughs in a low-viscosity state and flows about the trough structures. After the gel sealant flows about and occupies the trough structures, it partially solidifies and becomes more viscous. Once the gel sealant achieves a sufficient level of viscosity, i.e., becomes sufficiently solidified, the knife structures of the air filter panels enter the body of semi-solidified gel sealant and establish an air tight seal between the rail structures and the air filter panels. In this manner, air forced downward and against rail element grid and against the filter panels has no path through the ceiling module other than through the air filter panels. More particularly, because the rails themselves provide no air passage and because the gel sealant establishes an air tight coupling between the rails and the filter panels, no air passes through the module other than through the air filter panels.

Rail elements differ, however, at the perimeter of the ceiling modules. By providing a "half-rail" at the perimeter of each module, joining together two such half-rails from adjoining modules creates the equivalent of a complete rail structure spanning two adjoining ceiling modules. The structure thereby established is functionally equivalent to the interior rail structures of the module providing such features as a downward-facing channel and trough structures receiving gel sealant and the knife structures of the filter panels. Unfortunately, bringing together two such "half-rails" at the perimeter of adjoining ceiling modules introduces the possibility of alternate air passage ways, i.e., air leaks, relative to the ceiling structure. More particularly, the interface between two such half-rails provides opportunity for air flow bypassing the filter panels and degrading air filtration. In other words, it introduces the possibility of unfiltered air flow into the controlled environment.

The generally accepted method of preventing such unfiltered air flow into the controlled environment is by caulking material applied at the interface between half-rail elements, typically at the lower boundary of such face-to-face contact. In some cases, the half-rail elements include a corner-notch structure at the lower boundary of the face-to-face contact region between half-rails. When the half-rails come together, these corner-notch structures establish a downward-facing groove structure generally located at the upper portion of the downward-facing channel formed by the combined half-rails. Caulking material is then applied along the length of the combined half-rail structure in an attempt to prevent air flow through the face-to-face contact region between the half-rails, i.e., in an attempt to establish a seal against unfiltered air flow into the controlled environment.

Unfortunately, such caulking material has failed to satisfy completely the intended sealing function. Caulking material typically cannot be applied in uniform and continuous fashion, i.e., without stopping during application. At such lap points, i.e., where the application of caulking material temporarily stops, leaks typically occur. Also, caulking material itself has a limited functional life and, over time, tends to shrink the possibility of air leaks. Finally, requiring meticulous manual placement of caulking material introduces a significant additional manufacturing step at the installation site.

It would be desirable, therefore, to better prevent air flow bypassing the filtration system and thereby increase the quality of and control over air entering the controlled environment.

SUMMARY OF THE INVENTION

A ceiling module perimeter seal establishes an air-tight seal between modules forming a ceiling structure or between a module and an adjacent wall. The seal includes structures about the perimeter of modules and aligned relative to corresponding structures of an adjoining module. Aligned structures in adjacent ceiling modules establish an enclosure between modules suitable for receiving a seal including a gasket or for coupling to apertures fluidly connecting the enclosure with gel sealant troughs of the ceiling structure whereby gel sealant flowing in the troughs enters the enclosure and thereby establishes an air tight seal between adjoining ceiling modules.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

Under either embodiment of the present invention, first and second structures position for alignment to establish an enclosed space receiving a seal therein an providing an airtight interface between the first and second structures.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The particular embodiment shown herein will be illustrated in the context of a cleanroom facility with ceiling grid modules supporting air filter panels. Ceiling grid modules combine to establish a ceiling structure for a controlled and filtered environment. The subject matter of the present invention concerns joining together such ceiling grid modules to avoid air passageways, i.e. leaks, between modules.

Figure 1:
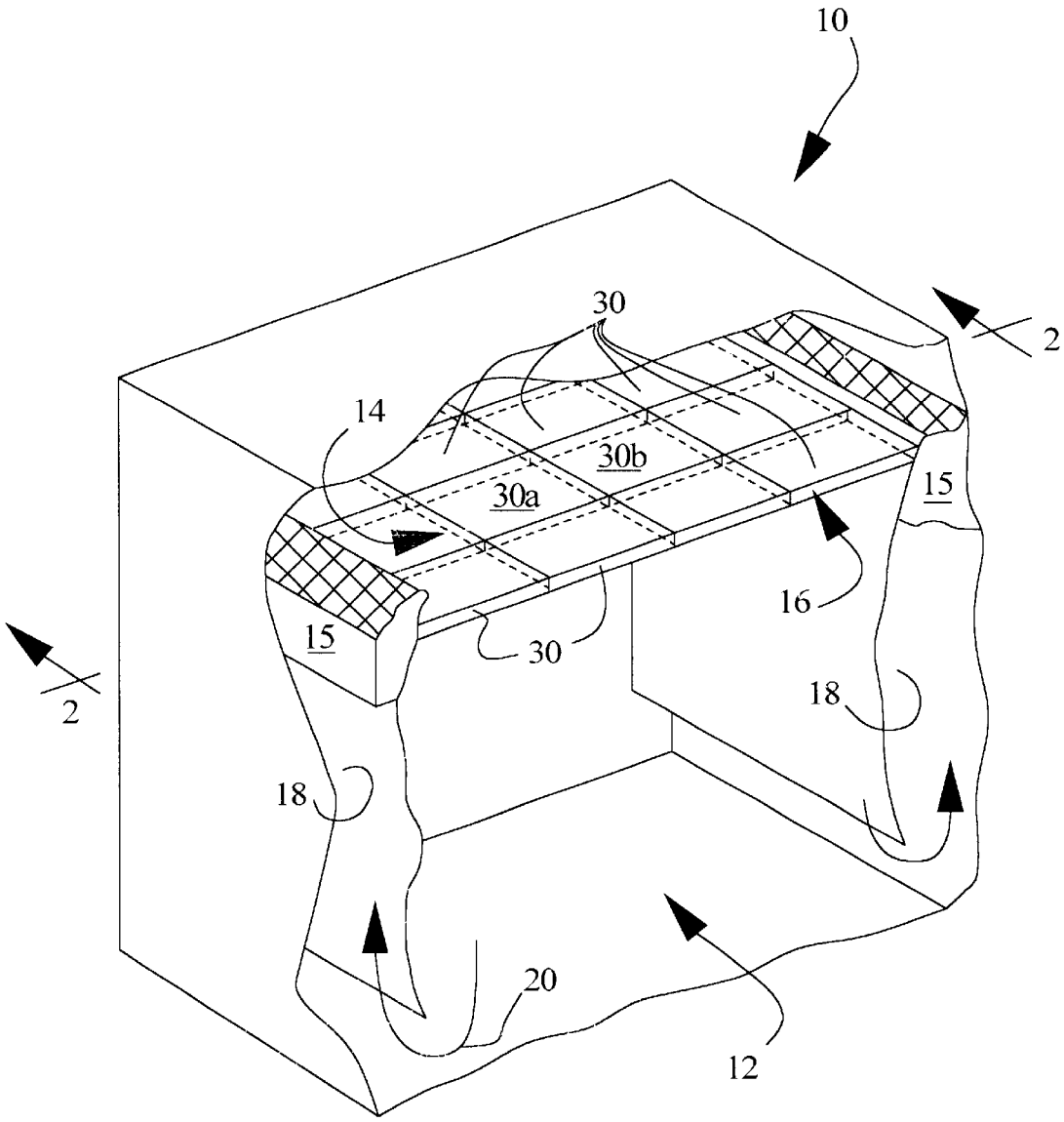
FIG. 1 illustrates schematically a cleanroom architecture including a plurality of ceiling modules establishing an overall ceiling structure.

FIG. 1 illustrates schematically the overall organization of a cleanroom 10. Cleanroom 10 includes a controlled environment space 12 and a plennum space 14. A ceiling structure 16 separates controlled environment space 12 and plennum space 14. Air movement or handling apparatus 15 pressurizes plennum space 14 to push air through filter elements, described more fully hereafter, of ceiling structure 16. A return air passage 18 carries a return air flow 20 from the controlled environment space 12 back to the plennum space 14 via air handling apparatus 15.

While a particular and schematic illustration of cleanroom architecture has been shown herein, it will be understood that a wide variety of structural arrangements may be employed in any given cleanroom or any controlled air filtration system. For example, a plennum may or may not be used. Duct work sometimes couples an air handling device directly with portions of a ceiling structure. Air movement can be accomplished by fan devices located adjacent to, e.g., directly above, the filter elements of a ceiling structure. In some cases, ceiling modules carry a plennum and duct work couples each ceiling module to an air handler. In all cases, air entering the controlled environment space must be of particular quality as provided by the filter elements. In systems with ceiling modules including plennums, the interface between modules must be sealed to avoid contamination from an interstitial space external of the plennums. Thus, the objective in any cleanroom architecture is to restrict air flow to the air filter panels, i.e., to avoid air passages bypassing the air filter panels and entering the controlled environment space 12. Ceiling structure 16, therefore, represents a boundary between the controlled environment space 12 and air to be forced through the filter elements of ceiling structure 16, in this particular case air in the plennum space 14. The present invention applies to a variety of cleanroom architectures not necessarily shown or discussed herein.

Figure 2:
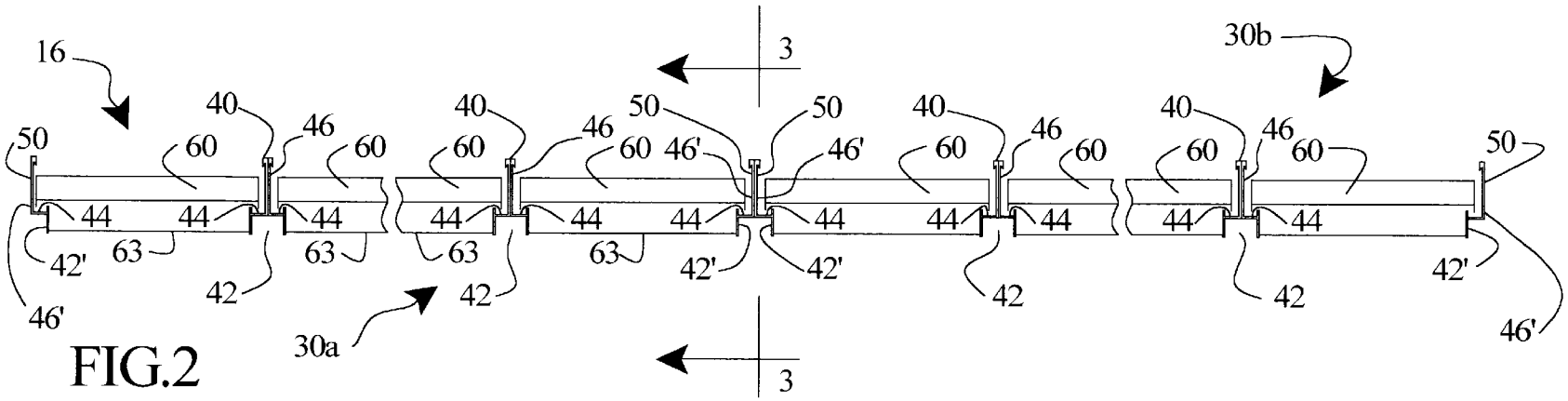
FIG. 2 illustrates two ceiling modules of the ceiling structure of FIG. 1, as taken along lines 2—2 of FIG. 1, and the interface therebetween including a perimeter seal according to a preferred embodiment of the present invention.

Ceiling structure 16 includes a collection of ceiling modules 30. Modules 30 collectively define ceiling structure 16. Each module 30 includes a grid of rail elements defining within each module rectangular openings receiving air filter panels 60 (FIG. 2). Such rail elements have a given and similar geometry. It is desirable that the rail elements be distributed throughout the ceiling structure 16 in a uniform pattern regardless of the underlying use of modules 30 defining ceiling structure 16. For example, the rail elements include a downward-facing channel and include upward-facing troughs. The downward-facing channels contain light fixtures and light elements illuminating the controlled environment 12. The upward-facing troughs receive gel sealant as an air tight seal between the rail members and the air filter panels. Thus, uniform distribution of such rail elements throughout ceiling structure 16 provides uniform distribution of illumination and filter panel 60 mounting sites. The perimeter of each module 30, however, presents only one half of a given rail element structure. When two modules 30 join together, such "half-rail" elements together establish a "full-rail" geometry similar to that of the rails within each of modules 30. This provides a continuous grid pattern of rail elements with similar geometry across the entire ceiling structure 16.

The following discussion focuses on two of modules 30, i.e., modules 30*a* and 30*b*, and the air tight coupling therebetween as provided under the present invention. It will be understood, however, that only two abutting modules 30 enjoy the same air tight coupling as described with respect to modules 30*a* and 30*b*.

In FIG. 2, modules 30*a* and 30*b* are shown in section, partially and isolated relative to the remainder of ceiling structure 16. Within module 30*a*, a rail 40 defines a downward-facing channel 42 and a pair of upward-facing gel sealant troughs 44 separated by a medial wall 46. Module 30*b* also has along its interior a similar rail 40 including a downward-facing channel 42 and upward-facing gel sealant troughs 44 separated by a medial wall 46. It will be understood that both module 30*a* and module 30*b* include multiple rails 40 organized in grid-fashion.

The perimeter of module 30*a,* however, includes half-rails 50, two such half-rails 50 of module 30*a* being visible in FIG. 2. Module 30*b* also includes about its perimeter half-rails 50. Each of half-rails 50 define one gel sealant trough 44 and a half-portion 42' of a downward-facing channel. Within each of modules 30, rails 40 and 50 define rectangular openings surrounded by gel sealant troughs 44. Filter panels 60, including about their perimeter downward-extending knife structures 62, sit within the corresponding troughs 44 as is conventional in the art. The knife structure 62 establish in conjunction with gel sealant within troughs 44 an air-tight seal relative to the rail elements. In this manner, all air through a given module 30 can pass only through the air filter panels 60. Below each filter panel 60, a screen 63 mounts to adjacent rail elements as is known in the art.

Modules 30 Join together in abutting side-by-side relation and place in face-to-face relation a pair of half-rails 50 as illustrated in FIG. 2 where modules 30*a* and 30*b* abut. Together, a pair of half-rails 50 define a structure similar to that of a rail 40. The half-portions 42' together define a downward-facing channel 42 and the troughs 44 match the overall geometry of the grid pattern established by all rail elements of all modules 30 in supporting filter panels 60.

Unfortunately, joining together two half-rails 50 as illustrated, and as is common in the art provides opportunity for undesirable air flow between modules 30. Under traditional methods of preventing such air flow, caulking material is placed along the bottom edge of the interface between modules 30, i.e., at the top of the downward-facing channel. This approach has not proven entirely successful in preventing air leaks between space 14 and space 12.

Figure 3:
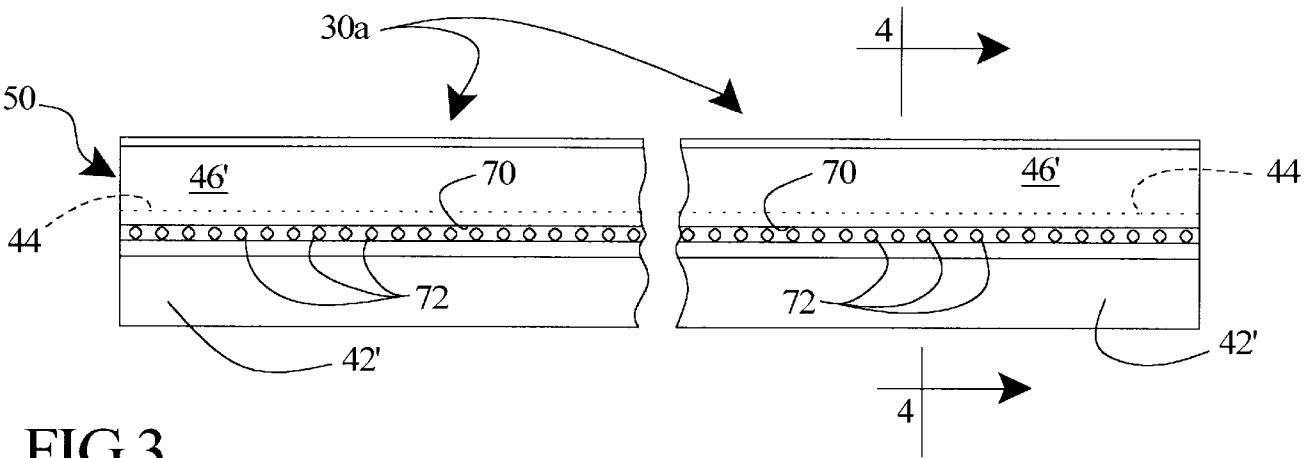
FIG. 3 illustrates one ceiling module as taken along lines 3—3 of FIG. 2.

FIG. 3 illustrates in more detail the interface between modules 30*a* and 30*b* and represents also the interface between any two abutting modules 30. In particular, FIG. 3 illustrates a side view of module 30*a* as taken along lines 3—3 of FIG. 2. In FIG. 3, portion 42' is visible along its entire length. The trough 44 is obscured behind medial wall 46'. Along the length of medial wall 46', a groove 70 lies approximately mid-height of the trough 44. A series of apertures 72 lie at the base of along the length of groove 70. Thus, apertures 72 fluidly couple a trough 44 and a groove 70. When a corresponding rail 50 abuts in face-to-face relation an adjacent rail 50, medial walls 46' come into face-to-face contact and grooves 70 align. This produces an enclosed gel-receiving space 76 (FIG. 4) along the length of the interface between a pair of rails 50. Space 76 fluidly communicates with two adjacent troughs 44 by virtue of apertures 72.

Figure 4:
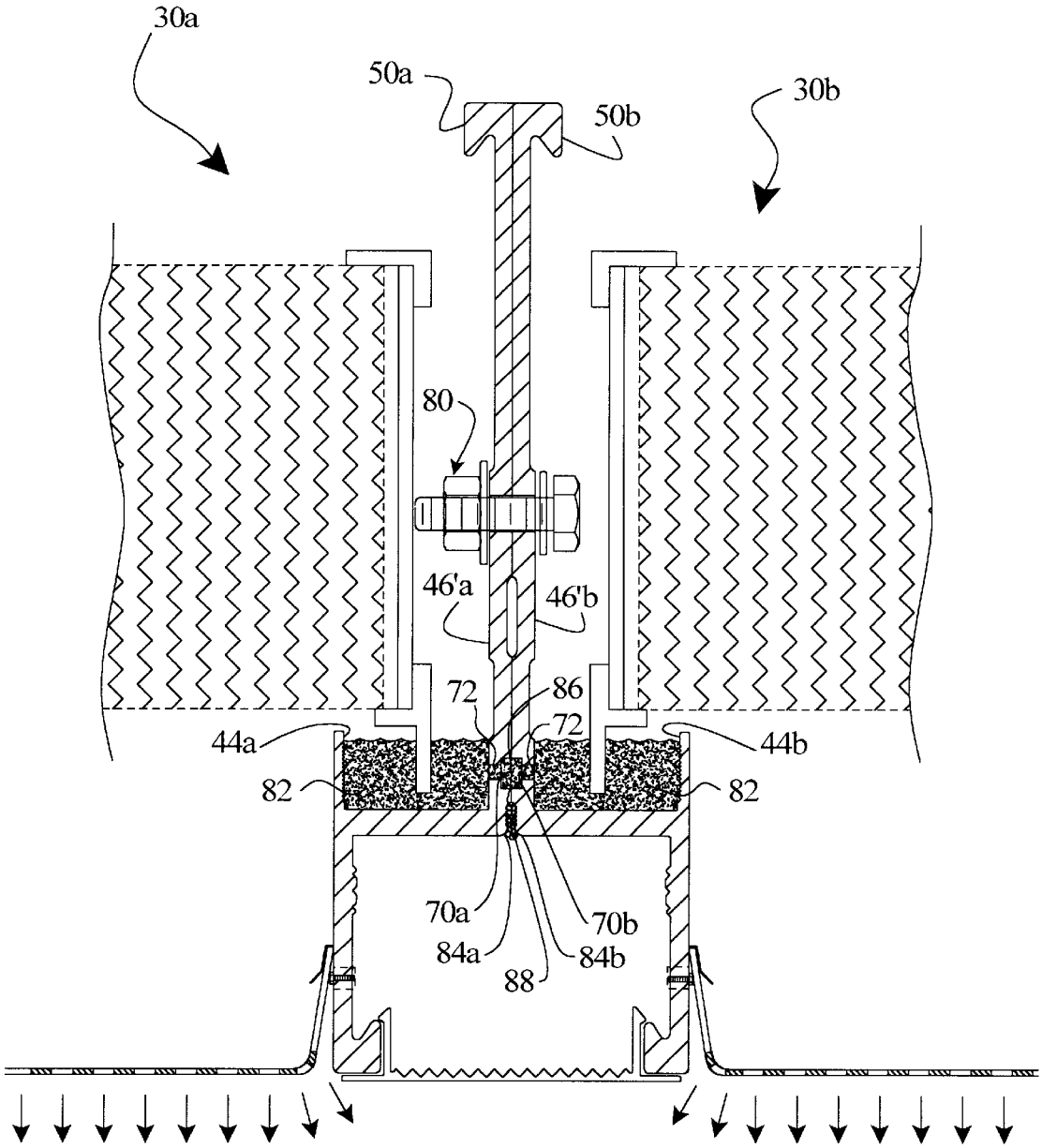
FIG. 4 illustrates in more detail the interface between the ceiling modules of FIG. 2 as taken generally along lines 4—4 of FIG. 3.

FIG. 4 illustrates in cross section, as taken along lines 4—4 of FIG. 3, the interface between modules 30*a* and 30*b*. In FIG. 4, half-rail 50*a* of module 30*a* and half-rail 50*b* of module 30*b* lie in face-to-face contact at medial walls 46*a*' and 46*b*'. A series of fasteners, e.g., nut and bolt fasteners, 80 secure together rails 50*a* and 50*b*. Medial wall 46*a*' of module 30*a* and medial wall 46*b*' of module 30*b* sit in face-to-face contact with groove 70*a* of module 30*a* in alignment with groove 70*b* of module 30*b* to establish gel receiving space 76 along the length of and between rails 50*a* and 50*b*. With apertures 72 along the length of each of rails 50*a* and 50*b* and in fluid communication with the corresponding troughs 44*a* and 44*b,* a low viscosity gel sealant 82 placed within troughs 44*a* and 44*b* migrates through apertures 72 and into gel receiving space 76. This places within space 76 a body of gel sealant 82 which seals the interface between rails 50*a* and 50*b* and thereby seals the interface between modules 30*a* and 30*b*. Notch formations 84, individually 84*a* and 84*b* on each rail 50*a* and 50*b,* respectively, create a downward-facing groove 86 when rails 50 join together. Groove 86 receives caulking material 88 prior to pouring gel sealant 82 into troughs 44. The sealant 82 migrates along troughs 44 and through apertures 72 into gel sealant receiving spaces 76 throughout ceiling 16. Caulking material 88 prevents excessive leakage of gel sealant 82 out of gel receiving space 76 until gel sealant 82 sufficiently solidifies and stops flowing. In practice, minute leaks in the caulking material 88 allow some of the low-viscosity gel sealant 82 therethrough, but upon solidification such leaks are blocked by gel sealant 82. In this manner, an air tight seal exists between half-rails 50*a* and 50*b*. After gel sealant 82 sufficiently solidifies, filter panels 60 are mounted, i.e., knife structures 62 inserted into troughs 44.

While the interface between two modules 30 has been illustrated, it will be understood that a similar interface and air-tight seal is established between any two modules 30 by use of half-rails 50 surrounding perimeter of each module 30. As a result, the gel receiving space 76 surrounds each module 30 and seals the interface between any two abutting modules 30. Where multiple modules 30 meet, e.g., such as where four modules 30 meet at a corner of each, the gel receiving space 76 exists across the interface among multiple modules 30.

Figure 5:
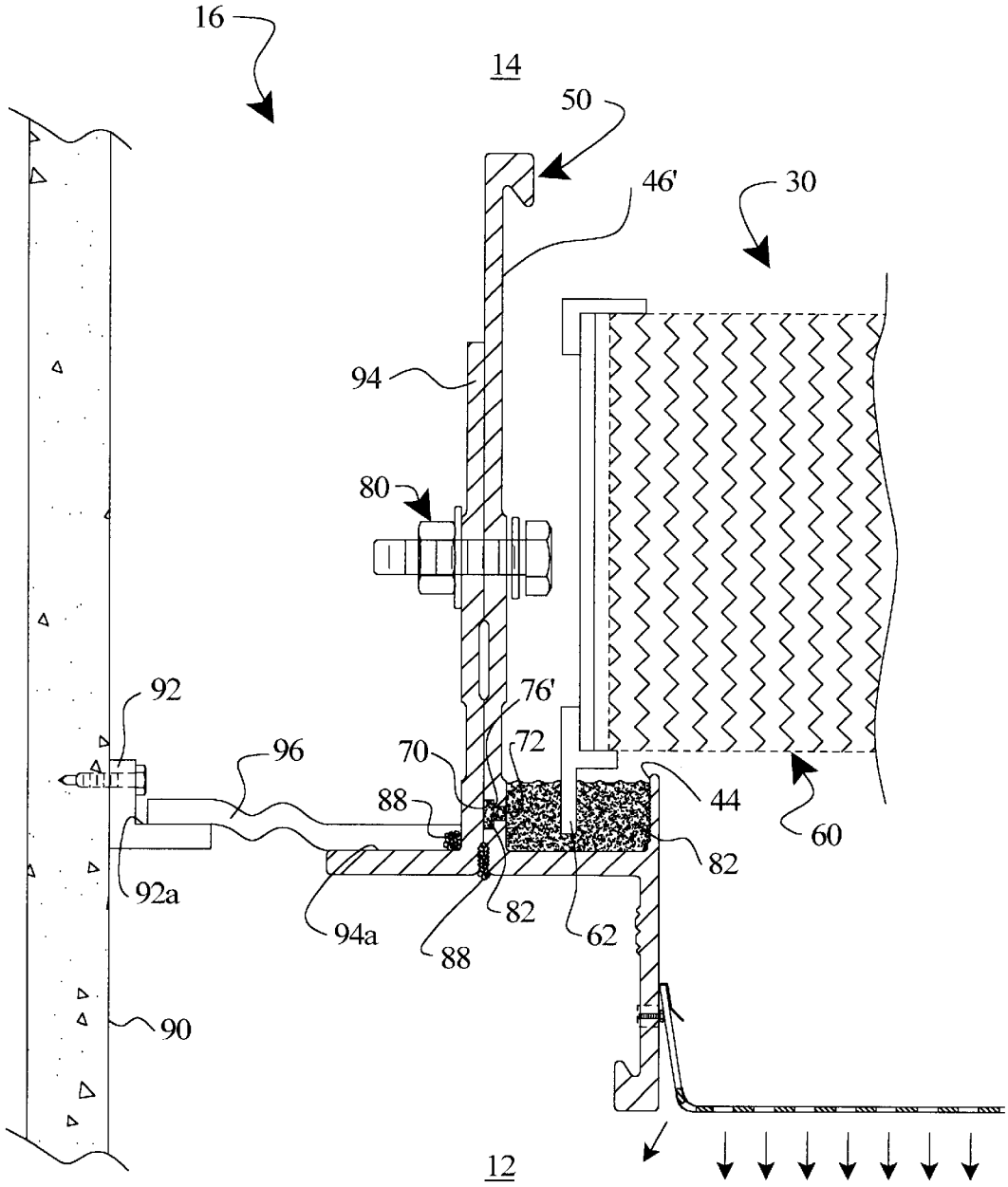
FIG. 5 illustrates application of the present invention at an interface between a ceiling module and a room wall.

FIG. 5 illustrates use of a half-rail 50 at the outer-edge of ceiling 16 to provide an airtight seal between a module 30 and a wall 90. Ceiling 16 must enjoy an air-tight seal relative to wall 90 which spans plennum space 14 and controlled environment space 12. A bracket 92, e.g., angle iron stock, attaches to wall 90 and provides a shelf 92*a*. A second bracket 94 attaches by means of a fastener 80 to medial wall 46' of half-rail 50. Bracket 94 provides a shelf 94*a*. As may be appreciated, shelf 92*a* and shelf 94*a* run along the entire length of a side of ceiling 16. A flexible rubber panel 96 rests upon shelves 92*a* and 94*a*. Panel 96 is attached in air-tight fashion, e.g., by gluing or other appropriate means, to shelves 92*a* and 94*a* to prevent any air flow from space 14 into space 12 at the interface of wall 90 and ceiling 16. Half-rail 50 includes a groove 70 lying along its length with apertures 72 therealong fluidly coupling groove 70 to a body of gel sealant 82 within trough 44 of rail 50. Groove 70, abutting bracket 94, provides a gel receiving space 76'. Caulking material 88, at the lower boundary of the interface between medial wall 46' and bracket 94, prevents leakage of gel sealant 82 from gel receiving space 76' while sealant 82 sufficiently solidifies as described above. In this manner, a seal may be established at the interface between ceiling 16 and a wall 90 to allow air passage only through filters 60 of ceiling 16.

The size and number of apertures 72 required depends on the ability of gel sealant 82 to migrate from troughs 44 into spaces 76. In practice, two inch spacing between apertures 72 of one quarter inch diameter has proven successful. A variety of materials may be used as gel sealant 82 including those well know in the art as BIOMED URETHANE GEL and TOUCH OF BLUE both available from Formula Brand Coating (FBC) and known in the art as SILICON GEL available from General Electric (G.E.).

As an alternative to use chalking material 88, gasket or tape material can be used to aid in sealing the interface half-rails 50. Tape may be easier and cleaner to install. Gaskets can be formed in coordination with complimentary receiving structures of half-rails 50 to better aid in establishing an air-tight seal.

Figure 6:
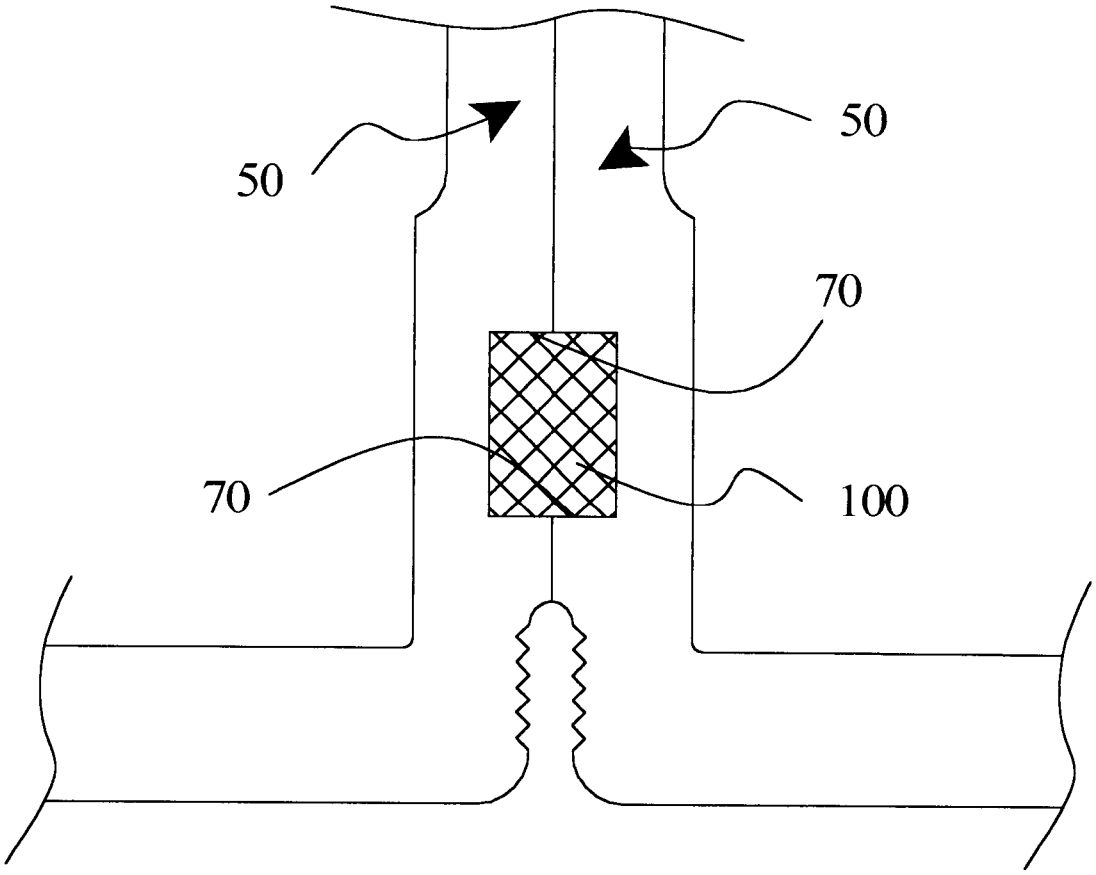
FIG. 6 illustrates an alternative embodiment of the present invention.

FIG. 6 illustrates an alternative embodiment of the present invention providing a seal between two half-rails 50 including corresponding grooves 70 therein. As an alternative to gel sealant 82, a gasket 100 rests within the space created by opposing grooves 70. Gasket 100 should be of appropriate size in relation to grooves 70 and of appropriate durometer or softness to establish an air-tight seal between half-rails 50. Gasket 100 can be a strip or ring structure. Also, separate gaskets 100 can be in opposing grooves 70 to cooperate when pressed together to establish an air-tight seal.

Thus, an improved ceiling module perimeter seal has been shown and described. Use of the seal as illustrated in the preferred embodiment of the present invention advantageously allows use of the gel sealant without significant modification to existing manufacturing or construction steps. The groove 70, when implemented in an extruded form of rails 50, constitutes a simple modification to existing manufacturing. In construction, the gel sealant flows from the troughs into the gel-receiving space to establish a seal between ceiling modules or relative to room walls without any significant additional work or construction steps required. Establishing an air tight seal between ceiling modules prevents air flow between or around ceiling modules and thereby improves overall air quality in a controlled environment such as a cleanroom environment.

It will be appreciated that the present invention is not restricted to the particular embodiment that has been described and illustrated, and that variations may be made therein without departing from the scope of the invention as found in the appended claims and equivalents thereof.

What is claimed is:

1. In a ceiling structure supporting filtration elements upon a grid of rail elements and constructed using at least two ceiling modules in side-to-side relation, a module perimeter seal comprising:

a first structure;

a second structure along one of said at least two ceiling modules and positioned for alignment with said first structure to establish an enclosed space adjacent said one of said first and second ceiling modules; and a seal within said enclosed space and establishing an air-tight interface thereat and relative to said one of said first and second ceiling modules.

2. A module perimeter seal according to claim 1 wherein said first structure is a portion of a second one of said first and second ceiling modules and said air-tight interface is between said first and second ceiling modules.

3. A module perimeter seal according to claim 1 wherein said first structure is a portion of a wall adjacent said one of said first and second ceiling structures and said air-tight interface is between said one of said first and second ceiling modules and said wall.

4. A module perimeter seal according to claim 1 wherein at least one of said first and second structures is a groove formation.

5. A module perimeter seal according to claim 1 wherein both of said first and second structures are groove formations.

6. A module perimeter seal according to claim 1 wherein said rail elements include at least one trough receiving gel sealant and at least one of said modules includes at least one aperture fluidly coupling said at least one trough and said enclosed space whereby gel sealant flowing in said at least one trough flows through said apertures and into said enclosed space.

7. A module perimeter seal according to claim 1 wherein said rail elements include troughs receiving gel sealant and said modules include apertures fluidly coupling said troughs and said enclosed space whereby gel sealant flowing in said troughs flows through said apertures and into said enclosed space.

8. A module perimeter seal according to claim 7 wherein said troughs receive knife structures of said filtration elements.

9. A module perimeter seal according to claim 1 wherein said seal is a gasket.

10. A module perimeter seal according to claim 1 wherein said first structure occurs along a second one of said first and second ceiling modules.

11. In a ceiling structure supporting filtration elements upon a grid of rail elements and constructed using at least two ceiling modules in side-to-side relation, a module perimeter seal comprising:

a first groove along a first one of said ceiling modules a second groove along a second one of said at least two ceiling modules and positioned for alignment with said first groove when said first and second ones of said ceiling modules are in said side-to-side relation to establish an enclosed space between said first and second ones of said ceiling modules; and a seal within said enclosed space and establishing an air-tight interface thereat between said first and second ceiling modules.

12. A module perimeter seal according to claim 11 wherein said rail elements include at least one trough receiving gel sealant and at least one of said modules includes at least one aperture fluidly coupling said at least one trough and said enclosed space whereby gel sealant flowing in said at least one trough flows through said apertures and into said enclosed space.

13. A module perimeter seal according to claim 12 wherein said troughs receive knife structures of said filtration elements.

14. A module perimeter seal according to claim 11 wherein said seal is a gasket.

15. In a ceiling structure including filter panels supported upon rail elements to establish an air filtration system, each rail element including at least one trough containing a gel sealant coupled to a filter panel, the ceiling structure comprising at least two ceiling modules in side-to-side relation, each module including at least one half-rail element at its perimeter, an improvement comprising:

a first groove along the length of a first one of said half-rail elements, said first groove including at least one first aperture therethrough and fluidly communicating with a trough of said first one of said half-rail elements;

a second groove along the length of a second one of said half-rail elements, said second groove including at least one second aperture therethrough and fluidly communicating with a trough of said second one of said half-rail elements; and a fastener coupling together said first and second half-rail elements and aligning said first and second grooves whereby gel sealant placed into and flowing along said troughs migrates through said at least one first and second apertures and into a gel receiving space defined by said first and second aligned grooves.

* * * * *